United States Patent [19]

Moe

[11] 3,931,973

[45] Jan. 13, 1976

[54] POCKETED GAME BOARD WITH MOVABLE BALL-PROPELLING MECHANISM

[75] Inventor: Walter Moe, Huntington, N.Y.

[73] Assignee: Aurora Products Corporation, West Hempstead, N.Y.

[22] Filed: Jan. 23, 1974

[21] Appl. No.: 435,961

[52] U.S. Cl. ..... 273/123 R; 273/9; 273/12; 273/129

[51] Int. Cl.[2] ..... A63F 7/10; A63D 3/02

[58] Field of Search ..... 273/3 R, 3 C, 8, 9, 12, 273/38, 118 R, 118 A, 119 R, 119 A, 120 R, 120 A, 121 R, 121 A, 122 R, 122 A, 123 R, 123 A, 124 R, 124 A, 125 R, 125 A, 129

[56] References Cited

UNITED STATES PATENTS

| | | | |
|---|---|---|---|
| 322,436 | 7/1885 | Ganser | 273/12 UX |
| 1,213,950 | 1/1917 | Ringsmith | 273/9 |
| 1,337,934 | 4/1920 | Madison | 273/129 |
| 2,317,289 | 4/1943 | McDonald | 273/129 |
| 3,704,889 | 12/1972 | Huffman et al. | 273/119 R |
| 3,794,324 | 2/1974 | Moe | 273/129 |

FOREIGN PATENTS OR APPLICATIONS

| | | | |
|---|---|---|---|
| 25,624 | 10/1903 | United Kingdom | 273/129 |
| 866,698 | 5/1941 | France | 273/129 |
| 358,717 | 10/1931 | United Kingdom | 273/38 |
| 1,210,231 | 10/1970 | United Kingdom | 273/119 A |

*Primary Examiner*—Richard C. Pinkham
*Assistant Examiner*—R. T. Stouffer
*Attorney, Agent, or Firm*—Amster & Rothstein

[57] ABSTRACT

A game of skill including a frame for supporting a game board having a plurality of ball-receiving pockets located about the periphery thereof and formed in the supporting frame of the game board. A ball-propelling mechanism including a base and a swingably mounted impact member is movable about the game board to propel a cue ball to impact with object balls. The base includes symmetrically-disposed recesses for receiving the cue ball so that it may be automatically aligned with the impact member. The ball-propelling mechanism is also provided with a sighting edge so that the impact member and cue ball may be properly aligned with an object ball. The supporting frame of the game board also includes rebound bumpers and a bumper mounting system which provides an enhanced rebound action to the playing balls.

4 Claims, 15 Drawing Figures

FIG. 5.
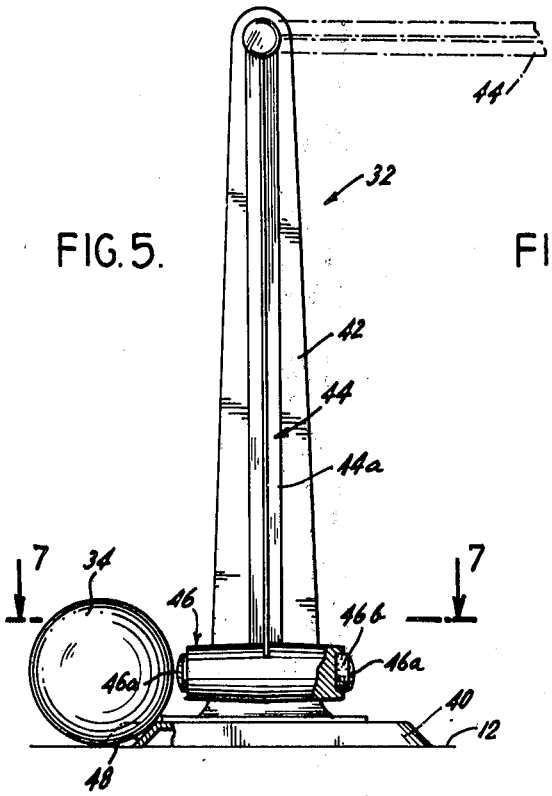
FIG. 6.
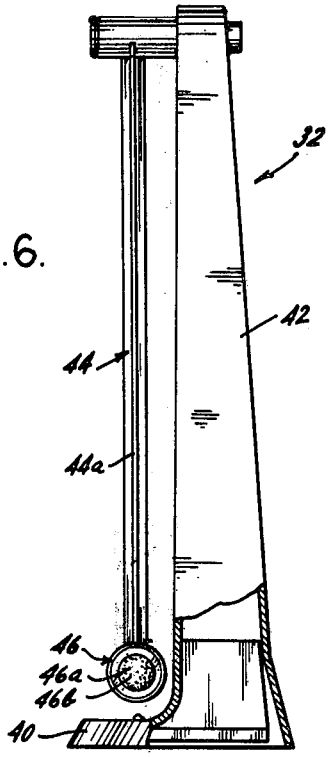
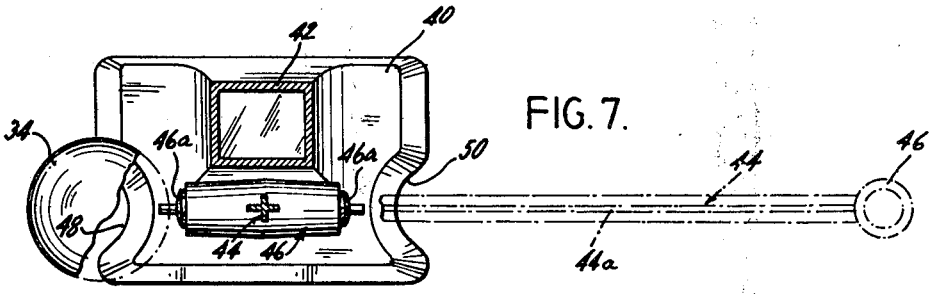
FIG. 7.
FIG. 8.
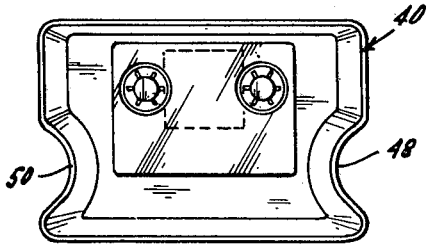
FIG. 9.
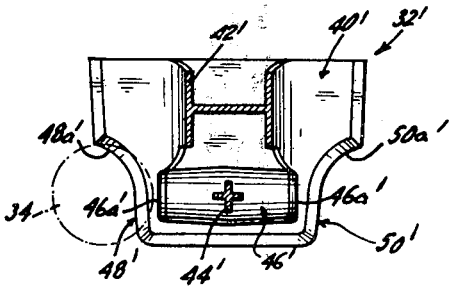

FIG. 12.
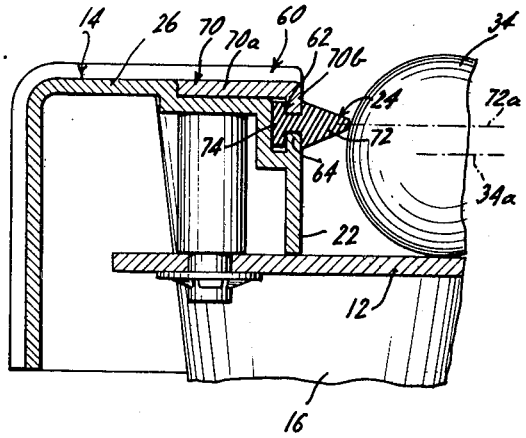
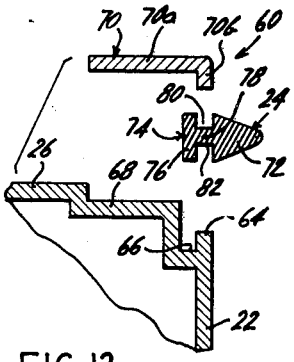
FIG. 13.
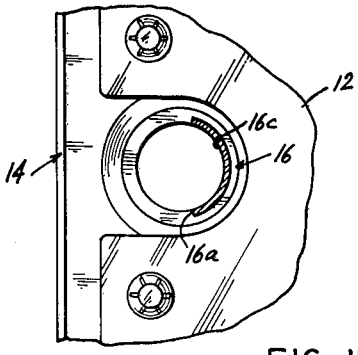
FIG. 15.
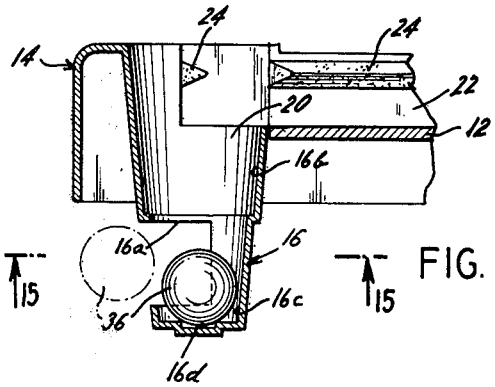
FIG. 14.
FIG. 10.
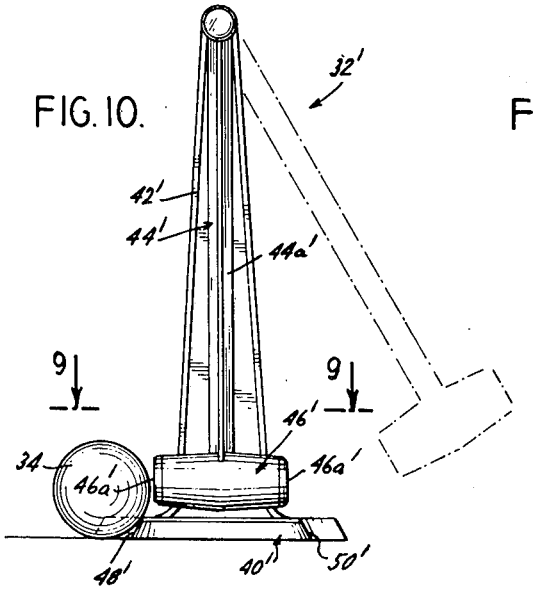
FIG. 11.
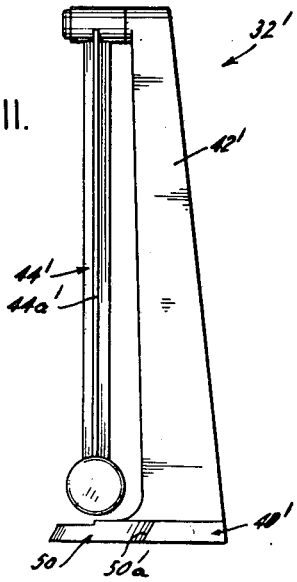

POCKETED GAME BOARD WITH MOVABLE BALL-PROPELLING MECHANISM

This invention relates generally to a game of skill and, more particularly, to a game which is a modified form of the popular parlor game known as billiards.

Throughout the years, various billiards games have become popular and are played by both children and adults. One popular form of the game of billiards is known as pool which is played on a pool table usually having six ball-receiving pockets, a cue ball and ten object balls. In one form of the game of pool, the player uses a cue stick to strike the cue ball to impact with and propel one or more object balls into any of the six pockets located around the pool table. The game requires a great deal of skill and practice on the part of the player as it is necessary for the player to properly line up the cue stick and the cue ball with the object ball so that the cue ball will strike the object ball at the proper angle to propel it into the desired pocket. Typically, each player continues to shoot and score points as long as the object balls are knocked into the pockets without having the cue ball knocked into one of the pockets. Of course, there are many other versions of this well known game of billiards.

Although the foregoing game has substantial play value and is interesting and intriguing to those who have the requisite skill, novices cannot totally enjoy the game as it requires such a great deal of skill and practice in order to play properly. Accordingly, still further excitement could be added to the game by introducing a device which the novice could use to improve his play of the game by substantially decreasing the amount of skill required. Such a device would add to the player's skill and control so that the game will have enhanced play value and substantial consumer interest.

The present invention is directed to a modified form of the game of billiards. More particularly, instead of the player employing a cue stick to strike the cue ball to impact with and propel an object ball into one of the ball-receiving pockets, a ball-propelling mechanism or pendulum cue having "built-in" skill and control is provided so that even a novice may play a relatively good game without the skill or practice heretofore required. In the play of the game, the player positions the pendulum cue so that the cue ball fits within one of the ball-receiving recesses formed in the base thereof. The player then uses a sighting edge formed on the pendulum cue to pivot the pendulum cue about the cue ball until it is in proper alignment with an object ball. In this manner, the pendulum cue is automatically lined up with the cue ball for perfect impact, and the cue ball, through the use of the sighting edge, is in proper alignment with the object ball to be impacted with and propelled into one of the ball-receiving pockets. Accordingly, as the novel pendulum cue of the present invention possesses a new dimension of "built-in" skill and control, it substantially reduces the amount of skill and experience required on the part of the player so that novices can play and enjoy the game with enhanced play value as it lends greater interest and excitement to this well-known game of billiards.

Accordingly, it is an overall object of the present invention to provide a game of skill which is like the conventional game of billiards, but has an interesting and new dimension of control in the play thereof. In its commercial form, the game is portable, is of relatively simple construction, is readily manufactured by mass production techniques at relatively low cost and includes a number of simple and relatively indestructible components.

It is a further object of the present invention to provide a pool table having a unique bumper and bumper mounting system for imparting improved rebound action to the playing balls.

It is a still further object of the present invention to provide a novel ball-receiving pockets formed in the supporting legs for the pool table.

In accordance with an illustrative embodiment demonstrating objects and features of the present invention, there is provided a game of skill which includes a game board or playing field having a plurality of ball-receiving pockets located about the periphery thereof and formed in the supporting frame of the game board. The supporting frame is provided with a plurality of supporting legs for supporting the game board with each of the supporting legs being hollow and open at the top thereof to form ball-receiving pockets shaped to receive and contain balls, yet permitting easy removal thereof through cutouts formed in the sides of the supporting legs. The game is provided with a ball-propelling mechanism or pendulum cue including an impact member and is movable about the game board so that it may be lined up with the cue ball and object ball. More particularly, in the play of the game, the shooter positions the ball-propelling mechanism about the cue ball with the cue ball being located in a ball-receiving recess formed in the base of the ball-propelling mechanism. In this manner, the center line of the cue ball is automatically lined up with the center line of the impact member so that the cue ball will be hit in its exact center and assure a perfect strike. In order to allow the shooter to easily line up the ball-propelling mechanism with one of the object balls, the ball-propelling mechanism is also provided with a sighting edge. In this manner, the shooter employs the sighting edge to line up the ball-propelling mechanism with the object ball to be impacted with by moving or pivoting the ball-propelling mechanism about the cue ball until the sighting edge indicates that the ball-propelling mechanism and object ball are in proper alignment. This automatically insures that the cue ball and object ball are in proper alignment for perfect impact. In addition, the frame of the pool table is provided with a novel bumper and bumper mounting system which greatly improves the rebound action imparted to the playing balls.

As in the conventional game of pool, the object of the present game of skill is for each player to propel the cue ball so that it will impact with an object ball at a proper angle to knock it into one of the ball-receiving pockets. However, in the present game, the player lines up the pendulum cue, cue ball and object ball and propels the cue ball all in a novel manner. More particularly, the novel ball-propelling mechanism of the present invention allows the shooter to automatically line up the impact member of the ball-propelling mechanism with the cue ball, and also allows the shooter to easily line up the ball-propelling mechanism and object ball by employing the sighting edge. Accordingly, in the game of the present invention, the shooter needs a minimum of skill and experience to knock the object balls into the ball-receiving pockets. However, in the conventional game of pool, a great deal of skill and practice is required before the shooter can accurately align the cue stick and cue ball to cause the cue ball to impact with the object ball at the proper angle. Accordingly, a new dimension of skill and control has been added to the conventional game of pool which thereby enhances the play value thereof. Of course, the present apparatus may be used to play any other game in which an object must be accurately propelled.

The above description as well as further objects, features and advantages of the present invention will be more fully understood by reference to the following detailed description of the presently preferred, but nonetheless illustrative embodiment in accordance with the present invention, when taken in conjunction with the accompanying drawings, wherein:

FIG. 5 is a front elevational view of a first embodiment of the ball-propelling mechanism of the present invention;

FIG. 6 is a side elevational view of the first embodiment of the ball-propelling mechanism;

FIG. 7 is a sectional view, taken substantially along the line 7—7 in FIG. 5 and looking in the direction of the arrows, illustrating in detail the alignment of the impact member of the ball-propelling mechanism with the cue ball;

FIG. 8 is a bottom plan view of the first embodiment of the ball-propelling mechanism;

FIG. 9 is a sectional view, taken substantially along the line 9—9 in FIG. 10 and looking in the direction of the arrows, illustrating the base of a second embodiment of the ball-propelling mechanism;

FIG. 10 is a front elevational view illustrating the second embodiment of the ball-propelling mechanism;

FIG. 11 is a side elevational view of the ball-propelling mechanism shown in FIG. 10;

FIG. 12 is an enlarged fragmentary sectional view, taken substantially along the line 12—12 in FIG. 1 and looking in the direction of the arrows, illustrating in detail the bumper and bumper mounting system of the present invention;

FIG. 13 is an exploded sectional view illustrating the assembly and mounting of the bumper on the supporting frame of the pool table;

Figure 1:
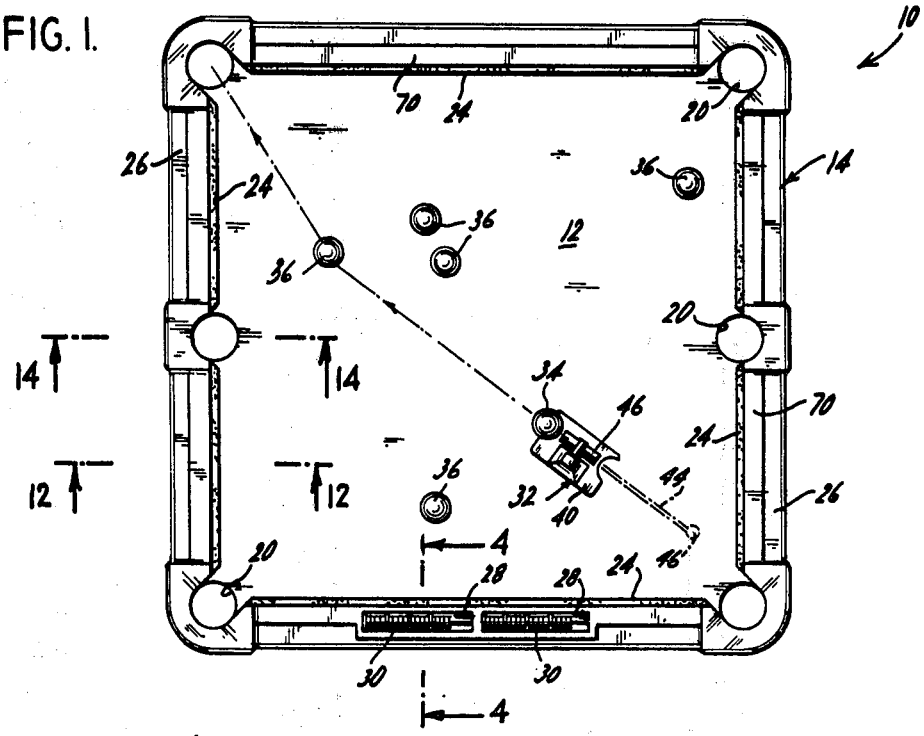
FIG. 1 is a top plan view of a representative form of the game of the present invention, illustrating the ball-propelling mechanism propelling the cue ball to knock one of the object balls into one of the ball-receiving pockets.

FIG. 14 is an enlarged fragmentary sectional view, taken substantially along the line 14—14 in FIG. 1 and looking in the direction of the arrows, illustrating further details of the supporting legs and the ball-receiving pockets formed therein; and FIG. 15 is a fragmentary sectional view, taken substantially along the line 15—15 in FIG. 14 and looking in the direction of the arrows, illustrating further details of one of the ball-receiving pockets of the present invention.

Figure 4:
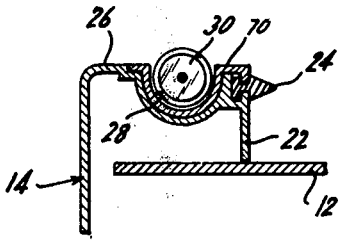
FIG. 4 is an enlarged sectional view, taken substantially along the line 4—4 in FIG. 1 and looking in the direction of the arrows, illustrating in detail the game board, the supporting frame and the scoring discs.

Referring now specifically to the drawings and in particular to FIG. 1, there is shown an illustrative game embodying features of the present invention, generally designated by the reference numeral 10, which includes a pool table having a game board 12 supported by a frame 14. Supporting frame 14 includes six supporting legs 16 at its periphery and one supporting leg 18 at the center thereof for supporting game board 12. Each supporting leg 16 is hollow and open at the top thereof to form a plurality of ball-receiving pockets 20 located about the periphery of game board 12, similar to the arrangement in a conventional pool table. Supporting frame 14 is also provided with upstanding rebound walls 22 which include a unique mounting arrangement for supporting rebound bumpers 24 and supporting frame 14 also includes a horizontally-extending top wall 26 joining upstanding rebounding walls 22. Top frame wall 26 is provided with a pair of recesses 28 formed therein for mounting slidably movable scoring discs 30, as shown in FIGS. 1 and 4. In this manner, scoring discs 30 may be employed to keep score as in the conventional game of pool. A ball-propelling mechanism or pendulum cue 32 is also provided and is movable about game board 12 to propel a cue ball 34 to impact with one or more playing balls 36 and knock them into ball-receiving pockets 20, in a manner which will be described below.

Figure 2:
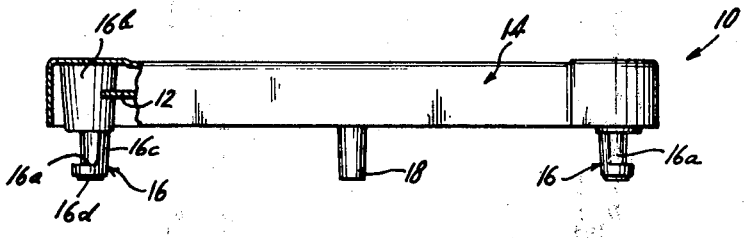
FIG. 2 is a side elevational view, with parts broken away and in section, illustrating the ball-receiving pockets formed in the supporting legs of the game board.
Figure 3:
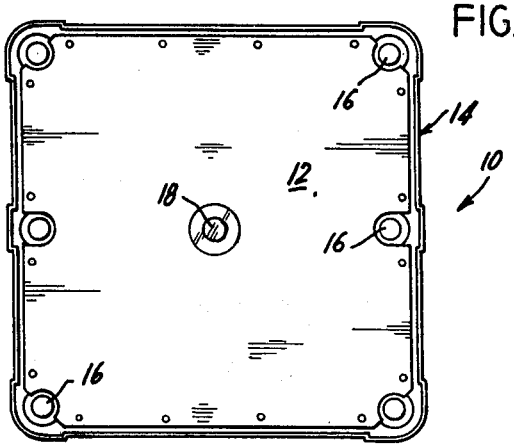
FIG. 3 is a bottom plan view of the game of the present invention.

In this illustrative form of the invention, which is particularly designed for the play of pool, six ball-receiving pockets 20 are formed in supporting frame 14 about the periphery of game board 12. More particularly, as shown most clearly in FIGS. 2, 14 and 15, ball-receiving pockets 20 are formed in hollow supporting legs 16 which are formed within supporting frame 14. As may be seen in FIG. 14, hollow supporting legs 16 are open at the top thereof and are shaped to receive and contain playing balls 36, yet permit easy removal thereof through cutouts **16*a* formed in the sides of supporting legs 16. More particularly, each supporting leg 16 includes an upper ball-receiving portion 16*b* integrally formed with a lower ball-retaining cup 16*c*. Ball-retaining cup 16*c* may also be formed with an indentation 16*d* for assuring that a ball is retained therein. In order to permit easy removal of playing balls 36 from each ball-retaining cup 16*c*, the side thereof is formed with cutout 16*a* which is of sufficient size so that a player may insert his hand or fingers through cutout 16 *a* to remove playing balls 36 from the ball-retaining cup 16*c***.

In order for the shooter to propel playing balls 36 along the playing surface of game board 12 and into one of the ball-receiving pockets 20, there is provided a ball-propelling mechanism or pendulum cue 32, as shown in FIGS. 5 through 8. More particularly, ball-propelling mechanism 32 is in the form of a movable stand which is movable about the playing surface of game board 12 in order to line up cue ball 34 and playing balls 36 so that cue ball 34 may accurately impact with one or more playing balls 36 and propel them into ball-receiving pockets 20. Ball-propelling mechanism 32 includes a base 40, an upstanding support 42 integrally formed with base 40, an actuating arm 44 pivotally attached to the upper end of upstanding support 42, and an impact member or mallet 46 integrally formed on the lower end of actuating arm 44 for engaging and propelling cue ball 34 or playing balls 36. Mallet 46 includes two identical impact faces **46*a* each formed by elastic inserts 46*b* to enhance the propelling action. Base 40 includes two identical and symmetrically-disposed ball-receiving cutouts or recesses 48, 50 formed on opposite sides of base 40. Ball-receiving recesses 48, 50 are formed within base 40 such that the center line of each ball-receiving recess is in alignment with the center line of each impact face 46***a*. In this manner, when one of the ball-receiving recesses 48, 50 is positioned about a cue ball 34 or playing ball 36, the center line of the ball is automatically lined up and in proper alignment with the center line of one of the impact faces 46*a* so that impact face 46*a* will strike the ball in its exact center. Further, each impact face 46*a* is disposed in a vertical plane (when actuating arm 44 is in the lowest portion of its swinging arc) such that each impact face 46*a* is substantially in the plane of the periphery of the ball supported within the corresponding ball-receiving recess 48 or 50. These factors, coupled with the fact that impact occurs when actuating arm 44 and impact member 46 are swinging through the lowest portion of their swinging arc, assures a perfect strike of the impact member 46 against the ball supported within ball-receiving recess 48 or 50. In this manner, ball-propelling mechanism 32 has "bult-in" skill and control.

Advantageously, the placement of ball-receiving recesses 48, 50 within base 40 enables the shooter to manipulate the ball-propelling mechanism 32 so that it may be brought extremely close to the rebound bumpers 24 of the pool table and yet will still be operable. For example, if cue ball 34 is quite close to one of the rebound bumpers 24, the shooter may place ball-propelling mechanism 32 between bumper 24 and cue ball 34 to propel cue ball 34 so that it will directly impact with one of the playing balls 36. Without such a construction of recesses 48, 50 within base 40, the shooter would need additional space to place a complete base adjacent the cue ball and the shooter could not orient ball-propelling mechanism 32 about cue ball 34 and place it between bumper 24 and cue ball 34. The shooter would therefore have to position ball-propelling mechanism 32 on the opposite side of cue ball 34 and propel it in a direction so that it will impact with bumper 24, rebound off of bumper 24 and impact with the desired playing ball 36. Of course, such a "rebound shot" is very difficult and requires a great deal of skill and practice as compared to a "direct shot" in which the cue ball directly impacts with the playing ball without the necessity of rebounding it off of one of the bumpers.

Once the shooter lines up ball-propelling mechanism 32 with the playing ball 36 which he or she desires to propel into one of the ball-receiving pockets 20, cue ball 34 will automatically be in alignment with the playing ball 36 to be impacted with. Accordingly, in order to allow the shooter to more easily line up ball-propelling mechanism 32 with one of the playing balls 36, actuating arm 44 is provided with a sighting edge 44*a*. In this manner, as shown in FIGS. 1 and 7, when the shooter lifts actuating arm 44 to the dotted line position, sighting edge 44*a* may be employed to line up ball-propelling mechanism 32 with the playing ball 36 to be impacted with. To accomplish this alignment process, the shooter may move or pivot recess 48 or 50 of ball-propelling mechanism 32 about cue ball 34 until sighting edge 44*a* indicates that the ball-propelling mechanism 32 and playing ball 36 are in proper alignment. This automatically insures that cue ball 34 and playing ball 36 are in proper alignment for perfect impact. In this manner, ball-propelling mechanism 32 again has "built-in" skill.

An alternative form of ball-propelling mechanism or pendulum cue 32 is shown in FIGS. 9 through 11 and is designated 32′ with parts corresponding to ball-propelling mechanism 32 being designated with corresponding prime numbers. Accordingly, ball-propelling mechanism 32′ includes a base 40′, an upstanding support 42′, an actuating arm 44′ pivotally attached to the upper end of upstanding support 42′ and an impact member or mallet 46′. As shown most clearly in FIG. 9, base 40′ also includes two identical and symmetrically-disposed cutouts or recesses 48′, 50′ for properly positioning cue ball 34 in alignment with either impact face 46*a′* of impact member 46′.

However, in this embodiment, ball-receiving recesses 48′, 50′ are not circular in shape. More particularly, by placing ball-propelling mechanism 32′ so that cue ball 34 is adjacent the arc 48*a′* formed in recess 48′ or adjacent the arc 50*a′* formed in recess 50′, the center line of cue ball 34 will automatically be lined up with the center line of impact member 46′ to insure perfect impact. In addition, actuating arm 44′ is also provided with a sighting edge 44*a′* which is used in a similar manner to that described with respect to the embodiment shown in FIGS. 5 through 8 to line up ball-propelling mechanism 32′ with one of the playing balls 36 and thereby automatically align cue ball 34 and the playing ball 36 to be impacted with.

Turning now to FIGS. 1, 12 and 13, there is shown the novel bumper mounting system 60 of the present invention for mounting rebound bumpers 24 along the upstanding rebound walls 22 of the pool table. As shown most clearly in FIG. 12, bumper mounting system 60 includes a T-shaped mounting groove 62 formed in upstanding rebound walls 22 adjacent the top thereof. T-shaped mounting groove 62 is defined by a lip 64 formed in the upper end of rebound wall 22, a slot 66 formed behind lip 64, a horizontally-extending recess 68 formed in top frame wall 26 and a locking cap 70 including a horizontally-extending portion 70*a* and a downwardly-extending lip 70*b* (cap 70 is somewhat modified to form recesses 28 as shown in FIG. 4). Correspondingly, rebound bumper 24 includes a curved forward bumper section 72 and an integrally formed T-shaped mounting section 74. T-shaped mounting section 74 includes a vertical mounting tab 76 connected to bumper section 72 by a shank 78. Between mounting tab 76 and bumper section 72, there is formed an upper recess 80 and a lower recess 82.

To mount rebound bumper 24, mounting tab 76 is inserted within slot 66 so that lip 64 is inserted and fits within lower recess 82. In addition, to secure bumpers 24 in place on supporting frame 14, locking cap 70 is inserted within recess 68 so that horizontal portion 70*a* fits within recess 68 and downwardly-extending lip 70*b* is inserted within the upper recess 80 of bumper mounting section 74. In this manner, the T-shaped mounting section 74 of rebound bumper 24 is securely mounted along the upper edge of upstanding rebound walls 22 so that only the curved forward bumper section 72 of rebound bumpers 24 protrude from rebound walls 22, as shown in FIG. 12.

In addition, as shown in FIG. 12, rebound bumpers 24 are mounted on upstanding rebound walls 22 such that the horicontal center line 72*a* of bumper section 72 is slightly above the center line 34*a* of cue ball 34 or the center lines 36*a* of playing balls 36. With this arrangement, and with the selection of the appropriate durometer and configuration of bumper section 72, an enhanced rebound action is imparted to the balls upon impact with rebound bumpers 24 assuring that they will be properly propelled in relation to the playing surface of game board 12. More particularly, when a cue ball 34 or playing ball 36 impacts with rebound bumper 24, the ball contacts the rebound bumper above their center lines 34*a* or 36*a*. Accordingly, upon impact, cue ball 34 or playing ball 36 is caused to rotate in a direction so that it will roll away from the rebound wall 22 impacted with. Advantageously, such an arrangement causes the rebound bumpers 24 to impart an improved rebound action to the rebounded cue ball 34 or rebounded playing balls 36.

From the foregoing, it will be appreciated that there has been provided in accordance with the present invention an improved game which substantially reduces the amount of skill and practice required by the player. The ball-propelling mechanisms of the present invention allows the shooter to automatically line up the impact member of the ball-propelling mechanism with the cue ball, and also allow the shooter to easily line up the ball-propelling mechanism and object ball by employing the sighting edge. In addition, rebound bumpers 24 may be quickly and easily mounted on rebound walls 22 and are arranged with respect to the playing balls to provide enhanced rebound action. Finally, the arrangement of the ball-receiving pockets formed in the supporting legs of the supporting frame allow playing balls to be conveniently removed therefrom.

A latitude of modification, change and substitution is intended in the foregoing disclosure. Accordingly, it is appropriate that the appended claims be construed broadly and in a manner consistent with the spirit and scope of the invention.

What is claimed is:

1. A game of skill comprising a plurality of playing balls, a game board having ball-receiving pockets formed therein adapted to receive said playing balls, a ball-propelling mechanism including a movable stand movable about said game board for propelling said playing balls into said ball-receiving pockets, said movable stand including a base, an upstanding support and an impact member, said impact member being pivotally mounted at one end thereof to said upstanding support, the other end of said impact member being free to swing through an arc having its axis formed by the axis of the pivotal mounting of said one end of said impact member with said upstanding support, said impact member being so mounted to said support as to pivot in one predetermined plane only, relative to said support, said base including at least one ball-receiving recess formed in said base, said recess being formed as an indentation in the edge of said base, said indentation being so structured that one of said playing balls when resting on the game board may be inserted therein by moving said indentation thereagainst, said one of said playing balls, when so inserted, being positioned for impact by said impact member, and when so inserted, being free of contact with said impact member except at the moment of said impact, said recess being so aligned with said impact member such that whenever said one of said playing balls is received therein, the center line of said one of said playing balls is in alignment with said predetermined plane, whereby said playing ball is projected in a direction parallel to, and coincident to, said predetermined plane.

2. A game of skill according to claim 1 further including supporting legs, attached to and supporting said game board said ball-receiving pockets in addition to being formed in said game board, also being formed so that a portion of each of said pockets is in one of said supporting legs.

3. A game of skill according to claim 2 wherein said ball-receiving pockets include means for removing playing balls therefrom, said removing means including an opening formed in the side of each of said supporting legs.

4. A game of skill according to claim 1 wherein said impact member includes an actuating arm having oppositely disposed impact faces, said actuating arm including a sighting edge for lining up said ball-propelling mechanism with said playing balls.

* * * * *